United States Patent [19]

Shimomura

[11] Patent Number: 4,904,302

[45] Date of Patent: Feb. 27, 1990

[54] ROLLER IN ROTARY COMPRESSOR AND METHOD FOR PRODUCING THE SAME

[75] Inventor: Soichi Shimomura, Yono, Japan

[73] Assignee: Nippon Piston Ring Co., Ltd., Tokyo, Japan

[21] Appl. No.: 270,652

[22] Filed: Nov. 14, 1988

[30] Foreign Application Priority Data

Nov. 20, 1987 [JP] Japan ..... 62-291746

[51] Int. Cl.[4] ..... C22C 29/12

[52] U.S. Cl. ..... 75/233; 75/232; 75/237; 419/11; 419/14; 419/16; 419/17; 419/19; 419/29; 419/38

[58] Field of Search ..... 75/232, 233, 237; 419/11, 14, 16, 17, 19, 29, 38

[56] References Cited

U.S. PATENT DOCUMENTS

| | | | |
|---|---|---|---|
| 4,518,563 | 5/1985 | Suganama et al. | 419/29 |
| 4,204,031 | 5/1980 | Takemura et al. | 419/11 |
| 4,071,382 | 1/1978 | Riopelle | 419/29 |

FOREIGN PATENT DOCUMENTS

| | | |
|---|---|---|
| 73082 | 4/1985 | Japan . |
| 174853 | 9/1985 | Japan . |

*Primary Examiner*—Stephen J. Lechert, Jr.
*Attorney, Agent, or Firm*—Oliff & Berridge

[57] ABSTRACT

Disclosed is a roller for use in a rotary compressor, which roller comprising a sintered body consisting essentially of 0.5–2.0% by weight of C, 1.0–5.0% by weight of Cu, 1.2–3.0% by weight of Mo and a balance of Fe and unavoidable impurities. In the sintered alloy, hard particles of Fe-Mo alloy are dispersed in one of pearlitic and tempering martensitic matrix, and sintered pores of the sintered body is sealed with tri-iron tetroxide. Resultant sintered body has high wear resistance and scuffing resistance capable of being used as an inverter type compressor.

3 Claims, 1 Drawing Sheet

ROLLER IN ROTARY COMPRESSOR AND METHOD FOR PRODUCING THE SAME

BACKGROUND OF THE INVENTION

The present invention relates to a roller formed of a sintered alloy having high wear resistance and assembled in a rotary compressor having high fluid tightness.

In a recent trend, a rotary comprressor for use with domestic electrifications becomes light in weight and more compact in size. Further, for the reduction of production cost and for high performance of the compressor, improvements have been made on materials of respective mechanical components of the compressor.

A rotary compressor mainly includes, as shown in FIGS. 1 and 2, an outer case 10, a cylindrical housing 11 assembled in the case 10 and formed with a vane groove 11A extending in radial direction of the housing, a roller 13 rotatable eccentrically in the housing 11, a shaft 14 integrally fixed to the roller 13 for its rotation, and a vane 12 slidably disposed in a vane groove 11A and moved in radial direction of the roller 13. A compression spring 15 is disposed in the groove 11A to urge the vane 12 radially inwardly. Therefore, a radially inner end face of the vane 12 is in slide contact with an outer peripheral surface of the roller 13. A working chamber is provided by a space defined between the housing 11 and the roller 13, and the vane 12 divides the chamber into intake and discharge chambers. The intake chamber is connected to an intake port 16 and the discharge chamber is connected to a discharge port 17. A fluid sucked in the working chamber is compressed and fed out by the eccentric rotation of the roller 13.

Among those components, the vane 12 and roller 13 perform relative sliding motion at high load, and therefore, these components must have high wear resistances. On this standpoint, various materials, for example, sintered alloy, have been proposed for the materials of the vane and roller.

However, regarding the material of the vane, SKH51 has been still a major material in an actual production. SKH 51 is defined by JIS (Japanese Industrial Standard), which is a high-speed tool steel, containing 0.80 to 0.90% of C, 3.80 to 4.50% of Cr, 4.50 to 5.50% of Mo, 5.50 to 6.70% of W, 1.60 to 2.20% of V and balance Fe.

Further, regarding the material of the roller, a sintered material has been employed as described above rather than a cast iron. According to the proposed sintered material, a hard metal carbide and a metal oxide formed by a steam treatment are dispersed in a matrix. Such sintered alloy is disclosed in Japanese Patent Application Kokai Nos. 60-73082 and 60-174853.

More specifically, according to the publication No. 60-174853, it discloses a sintered alloy consisting of 3–10% by weight of chromium, 1–5% by weight of graphite and balance iron and impurities. Metal carbide, metal oxide and free graphite are dispersed in the tempered martensitic matrix. The metal oxide is formed at interiors of sintered voids by steam treatment. This metal oxide seals the sintered voids to thereby obtain lubrication oil retainability.

According to the publication No. 60-73082, it discloses a rotary compressor. A rotor and/or a vane are formed of ferrous sintered alloy. Metal carbide and metal oxide are formed during tempering and are dispersed in the tempered martensitic matrix. Further, nitrogen is solid-solved in the martensitic matrix.

The above sintered material for the roller is intended to improve wear resistance and fluid-tightness. The metal oxide which seals sintered pores serves to enhance fluid-tightness of the compressor. However, with the use of such sintered material, a compressor roller has been burdened with much higher load because of the recent use of an inverter system. Accordingly, such sintered material may be worn out and undergoes scuffing if applied in the inverter system. In order to overcome this problem, there is a further demand for further improvement on wear resistivity and scuffing by using specific composition instead of conventional metal carbide dispersed in the matrix.

SUMMARY OF THE INVENTION

Accordingly, it is an object of this invention to prevent a roller for a compressor from being worn out or scuffing under a high load and to improve fluid-tightness of the compressor.

Another object of this invention is to provide an improved compressor roller capable of being used in an inverter system which provides extremely high load.

To achieve the object, according to this invention, there is provided a compressor roller formed of a sintered alloy consisting essentially of 0.5–2.0T by weight of C, 1.0–5.0% by weight of Cu, 1.2–3.0% by weight of Mo and a balance Fe and unavoidable impurities. Further, hard particles of Fe-Mo alloy are dispersed in a pearlitic or tempering martensitic matrix, and sintered pores of the sintered alloy are sealed with tri-iron tetroxide.

Further, according to the present invention there is provided a method for producing a roller of a compressor, said roller being formed of a sintered body produced by the steps of;

mixing together 1.0 to 2.0% by weight of graphite powders, 2.5 to 3.0% by weight of pure copper powders, 2.0 to 5.0% by weight of Fe-Mo alloy powders and balance pure iron powders to obtain a powder mixture; compacting the powder mixture to form a powder compact; sintering the powder compact to obtain a sintered body formed with sintered pores; and, steam treating said sintered body to seal the sintered pores, a resultant sintered body consisting essentially of 0.5–2.0% by weight of C, 1.0–5.0% by weight of Cu, 1.2–3.0% by weight of Mo and a balance Fe and unavoidable impurities, hard particles of Fe-Mo alloy being dispersed in pearlitic matrix, and the sintered pores being sealed with tri-iron tetroxide.

If martensitic matrix is intended, after sintering, there is provided the steps of hardening the sintered body; steam treating the hardened sintered body to seal sintered pores; and, tempering the sintered body, a resultant sintered body consisting essentially of 0.5–2.0% by weight of C, 1.0–5.0% by weight of Cu, 1.2–3.0% by weight of Mo and a balance of Fe and unavoidable impurities, hard particles of Fe-Mo alloy being dispersed in tempering martensitc matrix, and the sintered pores being sealed with tri-iron tetroxide.

DETAILED DESCRIPTION OF THE INVENTION

Figure 1:
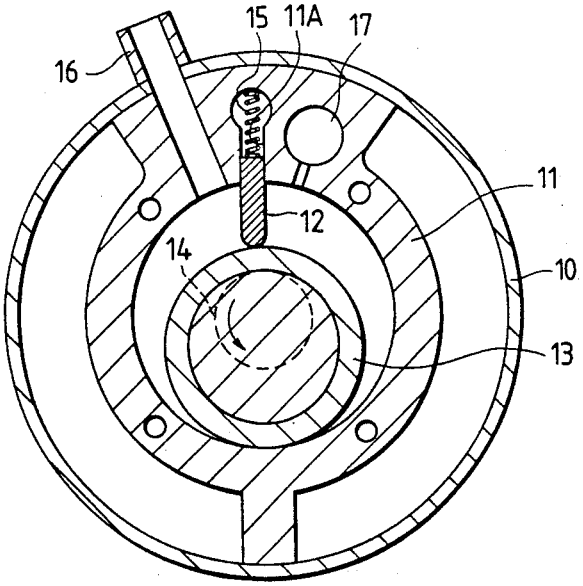
FIG. 1 is a vertical-cross section illustrating a structure of a compressor which employs a roller embodying this invention.
Figure 2:
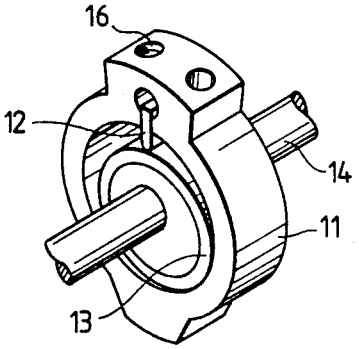
FIG. 2 is a perspective view showing the compressor showin in FIG. 1.

A roller of this invention is produced by adding 2.0 to 5.0% of Fe-Mo alloy powders to a mixture of graphite powders, pure copper powders and pure iron powders to obtain a powder mixture, compacting the powder mixture to obtain a powder compact, sintering the powder compact to obtain a sintered product with pearlitic matrix, and then subjecting the sintered product to a steam treatment or subjecting the sintered product to a sequential steps of hardening, steam treatment and tempering in order to provide a tempered martensitic matrix.

The pearlitic matrix has inherently high toughness. However, the martensitic matrix has higher hardness and increases the wear-resistance of the roller. After the sintering process, Fe-Mo powders are dispersed in the matrix as hard particles of Fe-Mo alloy to significantly improve the wear-resistance and scuffing resistance of the roller. With the amount of Fe-Mo powders at the time of initial adding process being less than 2.0%, sufficient wear-resistance would not be obtainable. On the other hand, if the addition amount of Fe-Mo alloy powders is more than 5.0%, resultant alloy has excessively high hardness to attack the opponent sliding members, such as the inner end portion of the vane and side housing plates of the compressor. Therefore, these opponent members are excessively worn out and further, such excessive amount of Fe-Mo alloy is disadvantageous in terms of manufacturing cost.

After the sintering, there exist continuous pores or open cells in the sintered product. Such open cells may degrade fluid-tightness of the compressor. Therefore, these sintered pores are sealed with tri-iron tetroxide ($Fe_3O_4$). This seal also contributes to the improvement of wear-resistance.

The following will describe the reasons for the percentagewise limitations on the respective compositions.

Carbon C will harden the matrix when solid-solved in the matrix. With this component being less tha 0.5% by weight, generation of pearlite and martensite is insufficient, to thereby reduce strength of the matrix. When carbon amount is more than 2.0% by weight, excessive amount of cementrite is generated in the matrix, thus render the resultant alloy brittle.

Copper will harden and stabilize the matrix. This effect is not prominent with the component being less than 1.0% by weight. On the other hand, further improved effect may not be obtainable when the component exceeds 5.0% by weight, so that such excessive amount of copper is economically disadvantageous, and further, segregation occurs to thereby lower dimensional accuracy of the final product.

The amount of the molybdenum is within a range of 1.2 to 3.0% by weight in the final sintered product, by adding 2.0 to 5.0% of Fe-Mo alloy powders in the powder mixture. The Fe-Mo alloy powders have fine and coarse particles. Upon the fine particles being solid solved in the matrix, quenching characteristic can be improved and temper embrittlement can be prevented. On the other hand, the coarse particles are dispersed as hard particles of Fe-Mo alloy in the matrix to improve the wear-resistance and scuffing-resistance. These effects are insufficient when the addition amount of the Fe-Mo powders is less than 2.0%. And, if the addition amount is more than 5.0%, the above mentioned opponent sliding members will be attacked by the sintered material and are worn out, which in turn is disadvantageous in cost.

A description will now be given with regard to results of performance tests according to the present invention.

[Method For Producing Specimens]

The powder mixtures indicated by No. 1–11 in Table 1 were prepared as raw materials of the roller. In Table 1, Nos. 1 through 5 belong to the present invention, and Nos. 6 thru 11 are comparative materials. Each of the powder mixtures was compacted at a pressure of 5–6 tons/cm$^2$ into a solid cylindrical shape having a diameter of 40 mm and an axial length of 10 mm. Then each of the powder compacts was subjected to various treatments shown in Table 2 where (steam) represents steam treatment; (heat) implies hardening and tempering, and (heat+steam) implies a combination of hardening, tempering and steam treatment. As a result, specimens were obtained which have the compositions, structures and hardness as shown in Table 2.

TABLE 1

| Specimen No. | Powder Mixture | |
|---|---|---|
| 1–5 | Graphite Powder: | 1.0–2.0% |
| | Pure Copper Powder: | 2.5–3.0% |
| | Fe—Mo Alloy Powder: | 3.0–4.0% |
| | Zinc Stearic Acid: | 1.0% |
| | Pure Iron Powder: | Balance |
| 6 & 7 | Graphite Powder: | 0.6–0.8% |
| | Pure Copper Powder: | 0.5–2.0% |
| | Fe—Mo Alloy Powder: | not more than 1.0% |
| | Zinc Stearic Acid: | 1.0% |
| | Pure Iron Powder: | Balance |
| 8 & 9 | Graphite Powder: | 1.3% |
| | Ni Powder: | 1.0% |
| | Mo Powder: | 1.3% |
| | Zinc Stearic Acid: | 1.0% |
| | Cr(1%)—Fe Alloy Powder: | Balance |
| 10 & 11 | Graphite Powder: | 1.35% |
| | Pure Copper Powder: | 3.0% |
| | Zinc Stearic Acid: | 1.0% |
| | Pure Iron Powder: | Balance |

As speciment No. 12 (compared material), prepared was FC 30 which is a gray cast iron consisting of C: 3.1%, Si: 2.3%, Mn: 0.7%, P: 0.11%, S: 0.04%, Cu: 0.3%, Cr: 0.2%, Fe: balance, and which is conventionally widely available as a roller material. The cast iron was of solid cyindrical shape having a diameter of 40 mm and a length of 10 mm and was subjected to hardening at a temperature of about 870° C.

[Test Conditions]

Figure 3:
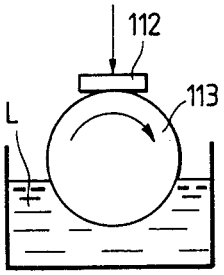
FIG. 3 is a schematic view showing a wear-testing manner.

The above specimens were subjected to wear test according to Amsler's basic method. Each of the columnar specimens No. 1–12 (corresponding to a roller) serving as a rotating part was assembled in a plane contact slide wear testing machine, and a SKH 51 plate (corresponding to a vane) having the size of 8 mm×7 mm×5 mm was also assembled in the machine for serving as a stationary part. As shown in FIG. 3, the stationary part 112 was in pressure contact with an outer peripheral surface of the specimen 113, and the latter was rotated at high speed about its axis for slide contact with the stationary part while supplying a lubricant L to the slide-contact section.

Condition details were as follows:

Load: 100 Kg

Peripheral Velocity: 1 m/sec.

Lubricant: freezing machine oil (equivallent to ISO 56)

Oil Temperature: 75° C.

Sliding Period: 20 hours.

Under the above conditions, the amount of wearing of the fixed part 112 and rotating part 113 were measured. The test results were shown in Table 2.

Further, scuffing test was also conducted according to the Amsler's wear test. The specimens involved in this test were the same as those involved in the above wear test. While rotating the rotating pieces No. 1–12 at the peripheral velocity of 1.13 m/sec., load of 10 kg was initially applied to the fixed part 112, and then, the load was added by 20 kg at every 2 minutes until the load reaches 50 Kg, and thereafter, added by 10 kg at every 2 minutes. The loads at which scuffing occurred were regarded as the maximum limit pressure to scuffing which is also shown in Table 2.

TABLE 2

| Specimen No. | | Composition (wt. %) C | Cu | Mo | Ni | Cr | Fe | Treatment | Structure | Hardness | Wear Amount (μ) Fixed Part | Rotating Part | Maximum Limit Pressure to Scuffing (Kg) |
|---|---|---|---|---|---|---|---|---|---|---|---|---|---|
| Present Material | 1 | 0.92 | 2.98 | 1.78 | — | — | Balance | (Steam) | Fe—Mo, $Fe_3O_4$ Dispersed in Pearlite | HRB 94 | 4.4 | 0.8 | 130 |
| | 2 | 0.92 | 2.98 | 1.78 | — | — | " | (Heat + Steam) | Fe—Mo, $Fe_3O_4$ Dispersed in Martensite | HRC 30 | 3.2 | 0.9 | 140 |
| | 3 | 1.22 | 2.95 | 1.81 | — | — | " | (Heat + Steam) | Fe—Mo, $Fe_3O_4$ Dispersed in Martensite | HRC 33 | 4.2 | 0.8 | 130 |
| | 4 | 1.53 | 2.92 | 2.40 | — | — | " | (Steam) | Fe—Mo, $Fe_3O_4$ Dispersed in Pearlite | HRC 24 | 4.0 | 0.9 | 150 |
| | 5 | 1.53 | 2.92 | 2.40 | — | — | " | (Heat + Steam) | Fe—Mo, $Fe_3O_4$ Dispersed in Martensite | HRC 40 | 2.5 | 0.7 | 150 |
| | 6 | 0.6 | 0.5 | 0.6 | — | — | " | (Heat + Steam) | $Fe_3O_4$ Dispersed in Martensite | HRC 25 | Scuffing | | 50 |
| | 7 | 0.8 | 2.0 | 0.6 | — | — | " | (Heat + Steam) | Fe—Mo, $Fe_3O_4$ Dispersed in Martensite | HRC 27 | Scuffing | | 70 |
| Compared Material | 8 | 1.02 | — | 1.34 | 1.04 | 0.98 | " | (Heat) | $Fe_3C$ Dispersed in Martensite | HRC 36 | 5.9 | 1.6 | 110 |
| | 9 | 1.02 | — | 1.34 | 1.04 | 0.98 | " | (Heat + Steam) | $Fe_3C$, $Fe_3O_4$ Dispersed in Martensite | HRC 40 | 5.8 | 1.2 | 110 |
| | 10 | 1.16 | 3.05 | — | — | — | " | (Steam) | $Fe_3O_4$ Dispersed in Pearlite | HRB 95 | 4.8 | 1.7 | 90 |
| | 11 | 1.16 | 3.05 | — | — | — | " | (Heat + Steam) | $Fe_3O_4$ Dispersed in Martensite | HRC 31 | Scuffing | | 80 |
| | 12 | | | | | FC30 | | | Gray cast iron | HRC 49 | 5.0 | 2.6 | 90 |

[Test Results]

As is apparent from the test results shown in Table 2, when using the present roller which contains hard particles of Fe-Mo alloy and is formed of specific components with their specific percentages, wear amounts of both roller and vane were smaller than those when using the comparative roller specimens. Further, the maximum limit pressure to scuffing in case of the employment of the present roller was much superior to the comparative cases. Therefore, excellent wear-resistance and scuffing-resistance are obtainable with respect to both vane and roller in the present invention as compared with the comparative cases.

Incidentally, in the compositions shown in Table 2, amount of components such as carbon were reduced in comparison with the original amount in the powder mixture shown in Table 1. This is due to the fact that such component may be scattered into atmosphere.

Figure 4:
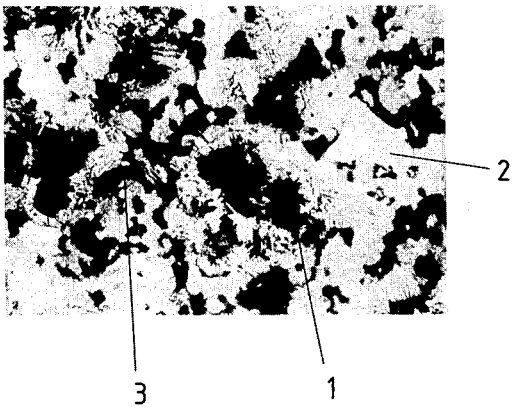
FIG. 4 is a microscopic photograph showing a structure of a sintered material for the roller of this invention.

FIG. 4 is a microscopic photograph (×200 magnifications) showing a metallic structure of specimen No. 1 of Table 1. The specimen was subjected to etching treatment with Niter Corrosion liquid. According to this photograph, hard particles of Fe-Mo alloy 2 and tri-iron tetroxides 3 are dispersed in pearlitic matrix 1.

As described above, the roller of this invention has excellent wear-resistance, scuffing-resistance and fluid-tightness, and will exhibits excellent performance when used particularly in a compressor which is burdened with a high load.

What is claimed is:

1. A roller for use in a rotary compressor, which roller comprising a sintered body consisting essentially of 0.5–2.0% by weight of C, 1.0–5.0% by weight of Cu, 1.2–3.0% by weight of Mo and a balance of Fe and unavoidable impurities; and wherein hard particles of Fe-Mo alloy are dispersed in one of pearlitic and tempering martensitic matrix, and sintered pores of said sintered body are sealed with tri-iron tetroxide.

2. A method for producing a roller for use in a rotary compressor, said roller being formed of a sintered body produced by the steps of:

mixing together 1.0 to 2.0% by weight of graphite powders, 2.5 to 3.0% by weight of pure copper powders, 2.0 to 5.0% by weight of Fe-Mo alloy powders and balance pure iron powders to obtain a powder mixture:

compacting said powder mixture to form a powder compact;

sintering said powder compact to obtain a sintered body formed with sintered pores; and, steam treating said sintered body to seal said sintered pores, a resultant sintered body consisting essentially of 0.5–2.0% by weight of C, 1.0–5.0% by weight of Cu, 1.2–3.0% by weight of Mo and a balance Fe and unavoidable impurities, hard particles of Fe-Mo alloy being dispersed in pearlitic matrix, and said sintered pores being sealed with tri-iron tetroxide.

3. A method for producing a roller for use in a rotary compressor, said roller being formed of a sintered body produced by the steps of:

mixing together 1.0 to 2.0% by weight of graphite powders, 2.5 to 3.0% by weight of pure copper powders, 2.0 to 5.0% by weight of Fe-Mo alloy powders and balance pure iron powders to obtain a powder mixture;

compacting said powder mixture to form a powder compact;

sintering said powder compact to obtain a sintered body formed with sintered pores;

hardening said sintered body;

steam treating said hardened sintered body to seal said sintered pores; and, tempering said sintered body, a resultant sintered body consisting essentially of 0.5–2.0% by weight of C, 1.0–5.0% by weight of Cu, 1.2–3.0% by weight of Mo and a balance of Fe and unavoidable impurities, hard particles of Fe-Mo alloy being dispersed in tempering martensitic matrix, and said sintered pores being sealed with tri-iron tetroxide.

* * * * *